US009581156B2

(12) United States Patent
Torii et al.

(10) Patent No.: US 9,581,156 B2
(45) Date of Patent: Feb. 28, 2017

(54) GEAR PUMP INCLUDING AN INNER ROTOR HAVING A PLURALITY OF TEETH

(71) Applicant: AISIN AW CO., LTD., Anjo-shi, Aichi-ken (JP)

(72) Inventors: Takahiro Torii, Hekinan (JP); Kengo Nomura, Nukata (JP); Minoru Todo, Takahama (JP); Mikio Iwase, Anjo (JP); Koji Ota, Anjo (JP); Mitsuhiro Takeda, Toyota (JP); Naoki Okoshi, Anjo (JP); Takumi Uchida, Obu (JP)

(73) Assignee: AISIN AW CO., LTD., Anjo-shi (JP)

( * ) Notice: Subject to any disclaimer, the term of this patent is extended or adjusted under 35 U.S.C. 154(b) by 38 days.

(21) Appl. No.: 14/417,988

(22) PCT Filed: Aug. 28, 2013

(86) PCT No.: PCT/JP2013/072996
§ 371 (c)(1),
(2) Date: Jan. 28, 2015

(87) PCT Pub. No.: WO2014/034717
PCT Pub. Date: Mar. 6, 2014

(65) Prior Publication Data

US 2015/0219097 A1 Aug. 6, 2015

(30) Foreign Application Priority Data

Aug. 28, 2012 (JP) ..... 2012-188115

(51) Int. Cl.
*F03C 4/00* (2006.01)
*F04C 2/00* (2006.01)
(Continued)

(52) U.S. Cl.
CPC ..... *F04C 2/14* (2013.01); *F04C 2/088* (2013.01); *F04C 2/102* (2013.01);
(Continued)

(58) Field of Classification Search
CPC ..... F04C 2/084; F04C 2/086; F04C 2/088; F04C 2/10; F04C 2/102; F04C 2/14;
(Continued)

(56) References Cited

U.S. PATENT DOCUMENTS 4,836,760 A 6/1989 MacLeod
6,896,500 B2 * 5/2005 Ike ..... F04C 2/084 418/171

(Continued)

FOREIGN PATENT DOCUMENTS

JP 59-82594 A 5/1984
JP 59-90788 A 5/1984

(Continued)

OTHER PUBLICATIONS

International Search Report for PCT/JP2013/072996 dated Dec. 3, 2013.

*Primary Examiner* — Theresa Trieu
(74) *Attorney, Agent, or Firm* — Sughrue Mion, PLLC

(57) ABSTRACT

In a gear pump, an outer inner wall surface of a suction port which is located on a downstream side in a rotor rotation direction, that is, a first inner wall surface, is located inward of a bottom land between internal teeth of an outer rotor, and the suction port has a shallow portion extended inward from the first inner wall surface on the downstream side in the rotor rotation direction, and a deep portion that is formed so as to be continuous with the shallow portion and that is deeper than the shallow portion. Communication between an inter-tooth chamber and the suction port is cut off with the inter-tooth chamber facing only the shallow portion.

20 Claims, 9 Drawing Sheets

(51) Int. Cl.

| | |
|---|---|
| ***F04C 18/00*** | (2006.01) |
| ***F04C 2/14*** | (2006.01) |
| ***F04C 2/08*** | (2006.01) |
| ***F04C 2/10*** | (2006.01) |
| ***F04C 15/00*** | (2006.01) |
| ***F04C 15/06*** | (2006.01) |

(52) U.S. Cl.
CPC ..... *F04C 15/0049* (2013.01); *F04C 15/06* (2013.01); *F04C 2/086* (2013.01); *F04C 2250/101* (2013.01); *F04C 2250/102* (2013.01)

(58) Field of Classification Search
CPC F04C 15/0049; F04C 15/06; F04C 2250/101; F04C 2250/102
USPC ..... 418/166, 171, 189, 190
See application file for complete search history.

(56) References Cited

U.S. PATENT DOCUMENTS

| | | | |
|---|---|---|---|
| 7,922,468 | B2 | 4/2011 | Chang |
| 2004/0202564 | A1 | 10/2004 | Ike et al. |
| 2010/0215537 | A1 | 8/2010 | Chang |
| 2012/0082579 | A1 | 4/2012 | Mori |

FOREIGN PATENT DOCUMENTS

| | | | |
|---|---|---|---|
| JP | 63-289278 | A | 11/1988 |
| JP | 9-4569 | A | 1/1997 |
| JP | 9-203381 | A | 8/1997 |
| JP | 2012-77638 | A | 4/2012 |
| WO | 03/048580 | A1 | 6/2003 |

* cited by examiner

GEAR PUMP INCLUDING AN INNER ROTOR HAVING A PLURALITY OF TEETH

TECHNICAL FIELD

The subject matter described herein relates to gear pumps including an inner rotor that has a plurality of external teeth and that is driven to rotate, and an outer rotor that has a plurality of internal teeth and that is placed so as to be offset with respect to the inner rotor.

BACKGROUND ART

Conventionally, a gear pump having a separation protrusion that separates an downstream end of a suction port into an inner end facing external teeth of an inner rotor and an outer end facing internal teeth of an outer rotor, a shallow flat surface formed to have a greater length in the circumferential direction as it extends closer to the outside in the radial direction from a protruding end portion of the separation protrusion, and a tilted bottom surface connected to an upstream edge of the shallow flat surface is known as this type of gear pump (see, e.g., Patent Document 1). In this gear pump, liquid that flows from the outer end of the suction port into the internal tooth side of an inter-tooth chamber whose communication with the suction port is about to cut off is limited by the shallow flat surface, and the liquid is made to flow from the inner end into the external tooth side of the inter-tooth chamber, thereby suppressing cavitation on the inner side of the external teeth.

Conventionally, a rotary pump is also known which has a suction port having an opening added in a linear portion connecting a small arc-shaped surface and a large arc-shaped surface at a terminal end in the rotation direction of an inner rotor (see, e.g., Patent Document 2). In this rotary pump, the opening is completely closed in an inner peripheral portion of the suction port by an end face of the inner rotor immediately before capacity of an inter-tooth chamber (space) is maximized. Moreover, a rotary pump is also conventionally known which has a suction port in which a linear portion connecting a small arc-shaped surface and a large arc-shaped surface at a terminal end in the rotation direction of an inner rotor to form a closing portion in the rotation direction is located on an extended line of a straight line passing through or near the center of an outer rotor, and a shape using a straight line, an arc, a trochoid curve, etc. is added to a portion defined by a trochoid curved surface of the inner rotor and an inscribed circle in each trochoid curved surface so that the edge wall of the suction port almost extends along the line defining the portion (see, e.g., Patent Document 3). In this rotary pump, the portion added in the shape using a straight line, an arc, a trochoid curve, etc. to the suction port is completely closed in an inner peripheral portion of the suction port by an end face of the inner rotor immediately before capacity of the inter-tooth chamber (space) is maximized. A volume pump is also conventionally known in which an outer edge in the radial direction has a suction port (intake port) formed so as to be located inward of the outer side of a gap between an inner gerotor and an outer gerotor (a bottom land between internal teeth) (see, e.g., Patent Document 4). In this volume pump, since the outer edge is located radially inward, fluid that has flown into the inter-tooth chamber prevents stirring of fluid returning to the suction port by a centrifugal pressure.

RELATED ART DOCUMENTS

Patent Documents

[Patent Document 1] PCT International Application Publication No. WO2003/048580

[Patent Document 2] Japanese Patent Application Publication No. S59-082594 (JP S59-082594 A)

[Patent Document 3] Japanese Patent Application Publication No. S59-090788 (JP S59-090788 A)

[Patent Document 4] Japanese Patent Application Publication No. S63-289278 (JP S63-289278 A)

SUMMARY OF THE INVENTION

According to the gear pump described in Patent Document 1, cavitation on the external tooth side of the inter-tooth chamber can be suppressed. However, even if the liquid flowing into the outer end is limited by the shallow flat surface, the fluid may leak from the inter-tooth chamber whose communication with the suction port is about to cut off into the outer end of the suction port, whereby cavitation may occur on the internal tooth side of the inter-tooth chamber. Similarly, in the rotary pumps described in Patent Documents 2, 3 as well, cavitation can be suppressed by closing the suction port by the inner peripheral portion. However, the fluid may leak from the inter-tooth chamber whose communication with the suction port is about to cut off into the outer peripheral-side region of the suction port, whereby cavitation may occur on the internal tooth side of the inter-tooth chamber. In the volume chamber described in Patent Document 4, suction efficiency is improved by narrowing the downstream side-end in the rotation direction of the suction port in the radial direction. However, there is also room for improvement in suction efficiency in the case where the inner rotor rotates at a high speed.

It is therefore a primary object to provide a gear pump that can improve suction efficiency while satisfactorily suppressing cavitation associated with suction of fluid.

A gear pump according to an exemplary embodiment has the following arrangement in order to achieve the above primary object.

A gear pump according to an exemplary embodiment includes an inner rotor that has a plurality of external teeth and that is driven to rotate, an outer rotor that has a plurality of internal teeth, that is placed so as to be offset with respect to the inner rotor, and that rotates together with the inner rotor with a part of the plurality of internal teeth meshing with a part of the plurality of external teeth, a suction port that communicates with such an inter-tooth chamber that increases in capacity with rotation of the inner rotor and the outer rotor out of a plurality of inter-tooth chambers defined by the external teeth and the internal teeth, and a discharge port that communicates with such an inter-tooth chamber that reduces in capacity with rotation of the inner rotor and the outer rotor out of the plurality of inter-tooth chambers, characterized in that an outer inner wall surface of the suction port which is located on a downstream side in a rotor rotation direction is located inward of a bottom land between the internal teeth, and the suction port has a shallow portion extended inward from the outer inner wall surface on the downstream side in the rotor rotation direction, and a deep portion that is formed so as to be continuous with the shallow portion and that is deeper than the shallow portion.

In this gear pump, the outer inner wall surface of the suction port which is located on the downstream side in the rotor rotation direction is located inward of the bottom land between the internal teeth. The outer inner wall surface thus restricts flow of fluid in an outward direction. Accordingly, the fluid can be collected on an inner side of the suction port, and can be made to flow into the inter-tooth chamber from the inner side of the suction port. This can improve filling efficiency in an inner part of the inter-tooth chamber, and can suppress cavitation. Moreover, the suction port of the gear pump has the shallow portion that is extended inward from the outer inner wall surface on the downstream side in the rotor rotation direction. This can increase a flow rate of the fluid that flows (is sucked) into the inter-tooth chamber located immediately before communication with the suction port is cut off, and can facilitate filling of the inter-tooth chamber with the fluid. As a result, this gear pump can improve suction efficiency while satisfactorily suppressing cavitation associated with suction of the fluid.

Communication between the inter-tooth chamber and the suction port may be cut off with the inter-tooth chamber facing only the shallow portion. This can further facilitate entry (suction) of the fluid into the inter-tooth chamber whose communication with the suction port is about to cut off, and can more satisfactorily suppress cavitation. In the present embodiment, the expression "communication between the inter-tooth chamber and the suction port is cut off" includes the state where small clearance is formed between the external tooth and the internal tooth so as to allow a small amount of fluid to flow from the suction port into the inter-tooth chamber, and the term "closest portion" includes both a portion where the external tooth and the internal tooth actually contact each other and a portion where the interval between the external tooth and the internal tooth is the smallest.

Moreover, the outer inner wall surface that is located upstream, in the rotor rotation direction, of a closing portion of the suction port where communication with the inter-tooth chamber is cut off may be located inward of the bottom land between the internal teeth that define the inter-tooth chamber located immediately before communication with the suction port is cut off. An end located on the downstream side of the suction port in the rotor rotation direction is thus formed so as to face approximately the entire external teeth of the inner rotor, whereby it is ensured that the suction port has a sufficient width in a rotor radial direction at this end.

The outer inner wall surface extending along the shallow portion may be a curved surface that is curved outward. A direction in which the fluid from the suction port flows can thus be smoothly changed by the outer inner wall surface extending along the shallow portion. This can maintain a high flow rate of the fluid flowing into the inter-tooth chamber located immediately before communication with the suction port is cut off Moreover, the outer inner wall surface of the suction port may include a first inner wall surface that extends inward from an outer periphery of the outer rotor, and a second inner wall surface that is continuous with the first inner wall surface and an inner inner wall surface of the suction port and that extends further inward than the first inner wall surface does, and the closing portion of the suction port where communication with the inter-tooth chamber is cut off may be determined on a continuous portion between the first inner wall surface and the second inner wall surface. Outward expansion of the first inner wall surface in the rotor radial direction is thus suppressed, and it is ensured that the suction port has a sufficient width in the rotor radial direction at its end on the downstream side in the rotor rotation direction. This can further improve suction efficiency while more satisfactorily suppressing cavitation associated with suction of the fluid.

The deep portion may include a tilted portion that is continuous with the shallow portion and that is formed so as to have a greater depth toward an upstream side in the rotor rotation direction. Flow of the fluid flowing in the suction port can thus be adjusted by the tilted portion, and the fluid can be smoothly guided into the expanded inter-tooth chambers.

Moreover, a tilt angle of the shallow portion may be smaller than that of the tilted portion. In this case, a surface of the shallow portion may be formed as a flat surface, or may be tilted so as to be located closer to the inter-tooth chamber as it gets closer to the outer inner wall surface from a boundary with the tilted portion.

Communication between the inter-tooth chamber and the suction port may be cut off as the closest portion between the external tooth and the internal tooth which are located on an upstream side of the inter-tooth chamber in the rotor rotation direction overlaps the closing portion of the outer inner wall surface. The fluid can thus be made to flow into (fill) the inter-tooth chamber after air is removed from the fluid flowing near the outer inner wall surface by the effect of centrifugal force. Cavitation can thus be satisfactorily suppressed especially when the inner rotor rotates at a high speed.

MODES FOR CARRYING OUT THE PREFERRED EMBODIMENT

A mode for carrying out the preferred embodiments will be described below with reference to the accompanying drawings.

Figure 1:
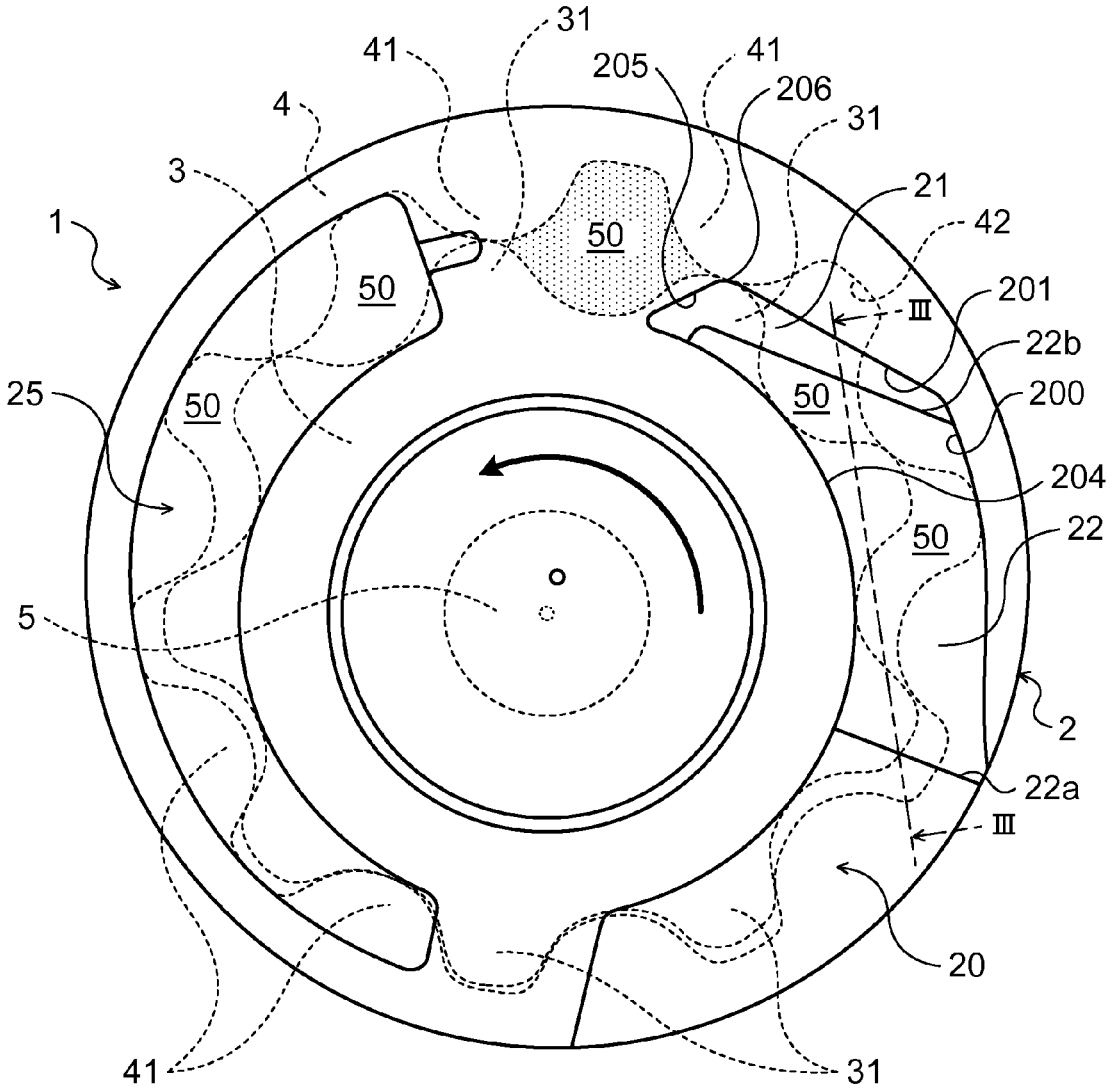
FIG. 1 is a schematic configuration diagram showing a gear pump 1 according to an exemplary embodiment.

FIG. 1 is a schematic configuration diagram showing a gear pump 1 according to an exemplary embodiment. The gear pump 1 shown in the figure is mounted as an oil pump on a vehicle, not shown, and sucks hydraulic oil (ATF) stored in an oil pan (not shown) to pressure-feed the sucked hydraulic oil to a hydraulic control device (not shown). The gear pump 1 includes a pump housing 2 formed by a pump body that is fixed to, e.g., a transmission case of an automatic transmission and a pump cover that is fastened to the pump body, and an inner rotor 3 and an outer rotor 4 which are rotatably placed in a gear accommodating chamber defined by the pump housing 2.

The inner rotor 3 is coupled to a rotary shaft 5 that is connected to a crankshaft of an engine (both not shown) mounted on the vehicle, not shown, and is driven to rotate by power that is applied to the rotary shaft 5. The inner rotor 3 has on its outer periphery a plurality of external teeth 31 having a trochoid tooth form, an involute tooth form, etc. The outer rotor 4 has internal teeth 41 formed on its inner periphery, and the number of internal teeth 41 is larger than that of external teeth 31 of the inner rotor 3 by one. The outer rotor 4 is rotatably placed in the gear accommodating chamber such that the plurality of internal teeth 41 located on the lower side in FIG. 1 mesh with the respective external teeth 31 of the inner rotor 3 and that the outer rotor 4 is offset with respect to the inner rotor 3. Moreover, a plurality of inter-tooth chambers (pump chambers) 50 are formed between the inner rotor 3 and the outer rotor 4 by the plurality of external teeth 31 and the plurality of internal teeth 41.

As the inner rotor 3 rotates in the direction shown by arrow in FIG. 1 by the power from the rotary shaft 5, a part of the plurality of internal teeth 41 meshes with a part of the plurality of external teeth 31, whereby the outer rotor 4 rotates together with the inner rotor 3 in the same direction about a rotation axis (see a solid circle in FIG. 1) that is separated by a predetermined distance from a rotation axis (see a dotted circle in FIG. 1) of the inner rotor 3. In a region (mainly the right-half region in FIG. 1) located on the upstream side in the rotation direction of the inner rotor 3 and the outer rotor 4 (hereinafter referred to as the "rotor rotation direction"), each inter-tooth chamber 50 is increased in capacity (expands) as the inner rotor 3 and the outer rotor 4 rotate. In a region (mainly the left-half region in FIG. 1) located on the downstream side in the rotor rotation direction, each inter-tooth chamber 50 is reduced in capacity (contracts) as the inner rotor 3 and the outer rotor 4 rotate.

The pump housing 2 has a suction port 20 extending in a substantially arc shape so as to communicate with (face) those inter-tooth chambers 50 which expand with rotation of the inner rotor 3 and the outer rotor 4 out of the plurality of inter-tooth chambers 50 defined by the external teeth 31 and the internal teeth 41, and a discharge port 25 extending in a substantially arc shape so as to communicate with (face) those inter-tooth chambers 50 which contract with rotation of the inner rotor 3 and the outer rotor 4 out of the plurality of inter-tooth chambers 50. The suction port 20 and the discharge port 25 may be formed on both sides of the inner rotor 3 and the outer rotor 4 (in both the pump body and the pump cover), or may be formed on one side of the inner rotor 3 and the outer rotor 4 (in one of the pump body and the pump cover). The suction port 20 may be formed on one side of the inner rotor 3 and the outer rotor 4, and the discharge port 25 may be formed on the other side of the inner rotor 3 and the outer rotor 4.

Figure 2:
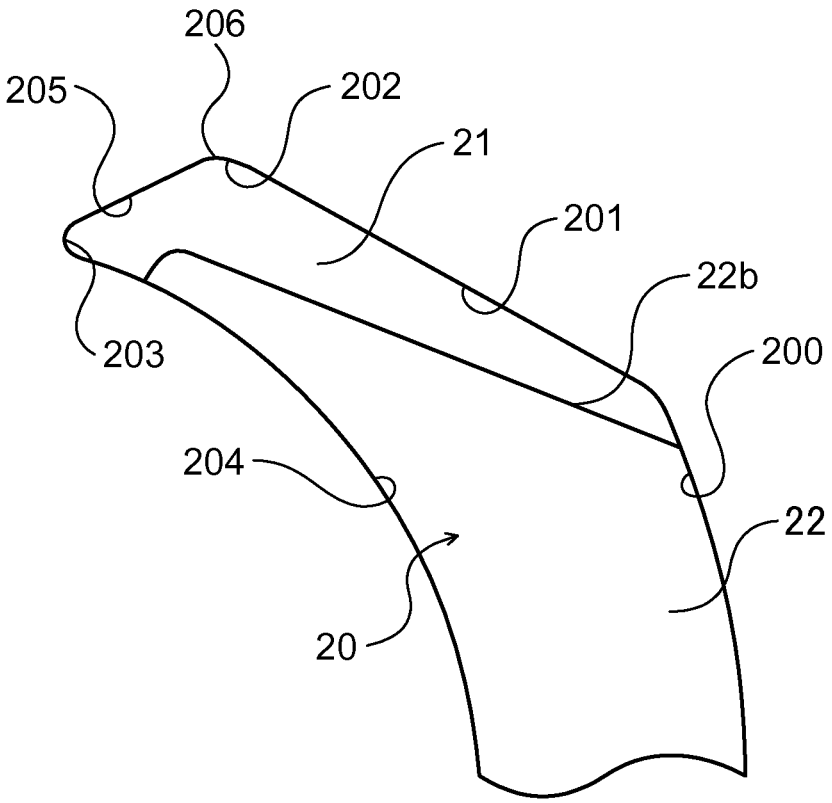
FIG. 2 is an enlarged view showing a suction port 20 of the gear pump 1.

As shown in FIGS. 1 and 2, an outer inner wall surface 200 of the suction port 20 includes a first inner wall surface 201 that extends inward (toward the rotation axis of the inner rotor 3 and the outer rotor 4) from the outer periphery of the outer rotor 4, and a second inner wall surface 205 that is continuous with the first inner wall surface 201 via a continuous surface 202 as a curved surface, that extends further inward (toward the rotation axis of the inner rotor 3 and the outer rotor 4) than the first inner wall surface 201 does, and that is continuous with an inner inner wall surface 204 of the suction port 20 via a continuous surface 203 as a curved surface.

Communication between the uppermost inter-tooth chamber 50 in FIG. 1 (see a shaded part in FIG. 1) and the suction port 20 is cut off when a contact portion (closest portion) between the external tooth 31 and the internal tooth 41 which are located on the upstream side of the inter-tooth chamber 50 in the rotor rotation direction overlaps a closing portion 206 determined on the outer inner wall surface 200 of the suction port 20, namely on the continuous surface 202 (continuous portion) between the first inner wall surface 201 and the second inner wall surface 205. A region located upstream of the closing portion 206 in the rotor rotation direction in the outer inner wall surface 200 of the suction port 20, namely the first inner wall surface 201, is located inward of (closer to the rotation axis of the inner rotor 3 and the outer rotor 4 than) a bottom land 42 between the two internal teeth 41 that define the inter-tooth chamber 50 whose communication with the suction port 20 is about to cut off (the inter-tooth chamber 50 located on the right side of the shaded part in FIG. 1).

In the present embodiment, both the first and second inner wall surfaces 201, 205 are flat surfaces. Those portions of the first inner wall surface 201 and the inner inner wall surface 204 which are located closer to the second inner wall surface 205, the continuous surfaces 202, 203, and the second inner wall surface 205 are formed so that the end located on the downstream side of the suction port 20 in the rotor rotation direction overlaps (faces) the external tooth 31 located on the upstream side of the inter-tooth chamber 50 where communication with the suction port 20 is cut off, in the rotor rotation direction. That is, the second inner wall surface 205 is formed so as to extend along the side surface (the left side surface in the figure) of the external tooth 31 located on the upstream side of the inter-tooth chamber 50 where communication with the suction port 20 is cut off in the rotor rotation direction, and the interval between the first inner wall surface 201 and the inner inner wall surface 204 near the second inner wall surface 205 is about the same as (e.g., slightly larger than) the whole depth of the external tooth 31.

Figure 3:
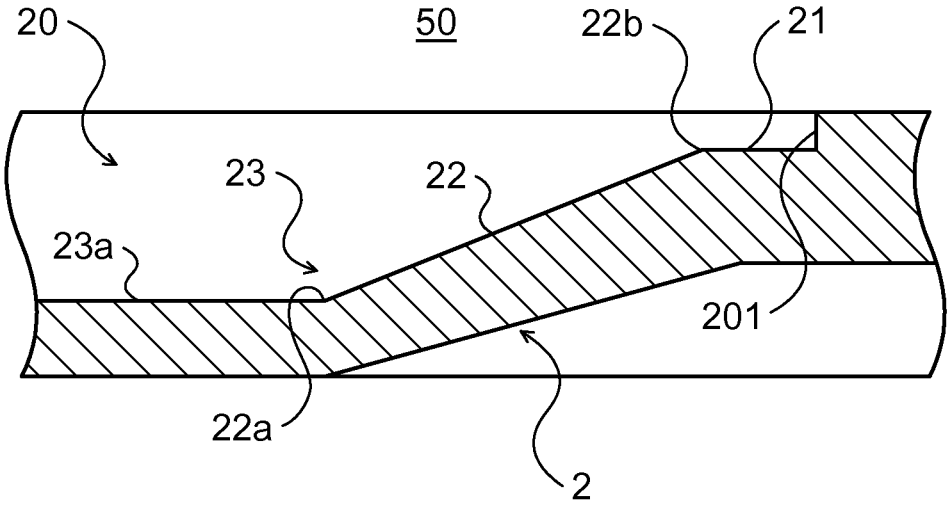
FIG. 3 is a sectional view taken along line III-III in FIG. 1.

Moreover, the suction port 20 has a flat shallow portion 21 formed in a region located on the downstream side in the rotor rotation direction, and a deep portion 23 that is continuous with the shallow portion 21 and that includes a tilted portion 22 formed so that its depth increases toward the upstream side in the rotor rotation direction. As shown in FIGS. 1 to 3, the shallow portion 21 has a flat surface that is extended inward, namely toward the rotation axis of the inner rotor 3 and the outer rotor 4, from the first inner wall surface 201 and the second inner wall surface 205 of the suction port 20, and that is located at a shallower depth than a bottom surface 23*a* of the deep portion 23 and the tilted portion 22 that extend along the first inner wall surface 201, the continuous surface 202, the second inner wall surface 205, the continuous surface 203, and a second inner wall surface 205 side-portion of the inner inner wall surface 204. The shallow portion 21 is formed parallel to the surfaces of the inner rotor 3 and the outer rotor 4. In the present embodiment, as shown in FIGS. 1 and 2, the shallow portion 21 extends along the entire length of all the continuous surface 202, the second inner wall surface 205, and the continuous surface 203. The inter-tooth chamber 50 faces only the shallow portion 21 of the suction port 20 immediately before communication between the inter-tooth chamber 50 and the suction portion 20 is cut off. That is, communication between the inter-tooth chamber 50 and the suction port 20 is cut off with the inter-tooth chamber 50 facing only the shallow portion 21. The tilted portion 22 of the deep portion 23 has a flat surface, and as shown in FIG. 3, the tilt angle of the surface of the tilted portion 22 is larger than that of the surface of the shallow portion 21. Moreover, in the present embodiment, the tilted portion 22 is formed so that the depth of the tilted portion 22 increases from a start end 22*a* to a boundary 22*b* with the shallow portion 21 as it extends closer to the downstream side in the rotor rotation direction, and so that the depth of the tilted portion 22 is greater on the inner side than on the outer side in the radial direction of the inner rotor 3. The flow rate of hydraulic oil flowing in the tilted portion 22 is higher in the radially inward part of the tilted portion 22 than in the radially outward part thereof.

Operation of the gear pump 1 configured as described above will be described below.

When an engine mounted on a vehicle is started and the inner rotor 3 is driven to rotate via the rotary shaft 5 by power from the engine, a part of the plurality of internal teeth 41 meshes with a part of the plurality of external teeth 31, whereby the outer rotor 4 rotates together with the inner rotor 3 in the same direction. Hydraulic oil is thus sucked via the suction port 20 into the plurality of inter-tooth chambers 50 that face (communicate with) the suction port 20 and expand with the rotation of the inner rotor 3 and the outer rotor 4. At this time, the flow of the hydraulic oil flowing in the suction port 20 is adjusted by the tilted portion 22, and the hydraulic oil is smoothly guided into the expanded inter-tooth chambers 50.

In the gear pump 1, communication between the uppermost inter-tooth chamber 50 in FIG. 1 and the suction port 20 is cut off as the contact portion between the external tooth 31 and the internal tooth 41 which are located on the upstream side of the inter-tooth chamber 50 in the rotor rotation direction overlaps the closing portion 206 determined on the continuous surface 202 between the first inner wall surface 201 and the second inner wall surface 205 of the suction port 20. The portion located upstream of the closing portion 206 in the rotor rotation direction in the outer inner wall surface 200 of the suction port 20, that is, the first inner wall surface 201, is located inward of the bottom land 42 between the two internal teeth 41 defining the inter-tooth chamber 50 whose communication with the suction port 20 is about to cut off. In the gear pump 1, outward expansion of the first inner wall surface 201 in the rotor radial direction is thus suppressed, and the end located on the downstream side of the suction port 20 in the rotor rotation direction is formed so as to face approximately the entire external teeth 31 of the inner rotor 3, whereby it is ensured that the suction port 20 has a sufficient width in the rotor radial direction at this end. This can further improve suction efficiency while more satisfactorily suppressing cavitation associated with suction of hydraulic oil into the inter-tooth chambers 50. In the gear pump 1, the inter-tooth chamber 50 faces only the shallow portion 21 immediately before communication between the inter-tooth chamber 50 and the suction port is cut off. That is, in the gear pump 1, communication between the inter-tooth chamber 50 and the suction port 20 is cut off with the inter-tooth chamber 50 facing only the shallow portion 21. Thus, the pressure of the hydraulic oil decreases in the shallow portion 21, which facilitates entry (forcing, i.e., filling) of the hydraulic oil into the inter-tooth chamber 50 whose communication with the suction port 20 is about to cut off, whereby cavitation can be more satisfactorily suppressed.

The hydraulic oil thus sucked into the inter-tooth chamber 50 is pressure-fed into the discharge port 25 from those inter-tooth chambers 50 which face (communicate with) the discharge port 25 and contract with rotation of the inner rotor 3 and the outer rotor 4. The hydraulic oil that is discharged from the discharge port 25 is supplied to the hydraulic control device etc. via an oil passage formed in the transmission case etc.

Figure 4:
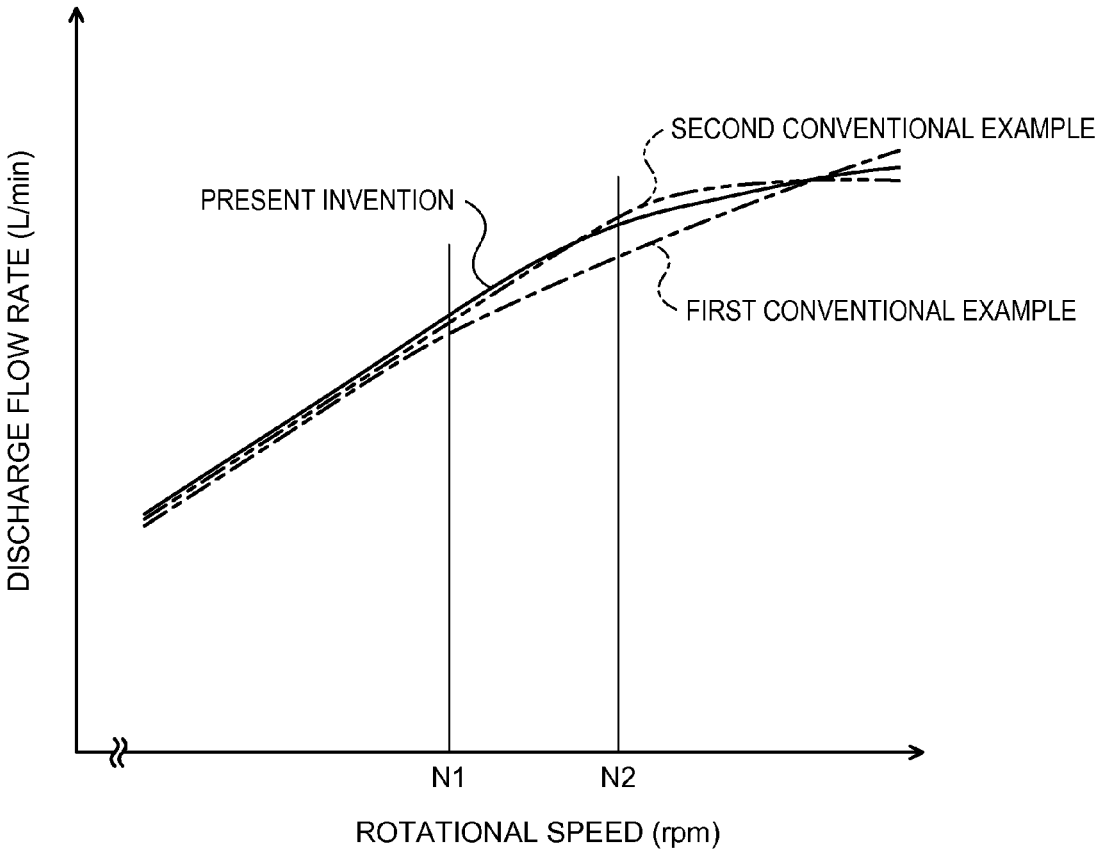
FIG. 4 is a graph showing comparison in fluid suction efficiency between a gear pump according to an exemplary embodiment and gear pumps of conventional examples.

FIG. 4 is a graph showing comparison in fluid suction efficiency between a gear pump according to the present embodiment and gear pumps of conventional examples. In the figure, solid line shows the analysis result of the relation between the rotational speed of the inner rotor 3 and the discharge flow rate in the gear pump of the present embodiment which has a configuration similar to that of the gear pump 1. Chain line shows the analysis result of the relation between the rotational speed of the inner rotor 3 and the discharge flow rate in a gear pump of a first conventional example which has a configuration similar to that of the gear pump described in Patent Document 1. Two-dot chain line shows the analysis result of the relation between the rotational speed of the inner rotor 3 and the discharge flow rate in a gear pump of a second conventional example which has a configuration similar to that of the gear pump described in Patent Document 2. The gear pumps of the present embodiment and the first and second conventional examples are configured as oil pumps having the same capacity, and the analysis of the gear pumps of the present embodiment and the first and second conventional examples was carried out for a high rotational range where the rotational speed of the inner rotor 3 is, e.g., 3,000 to 4,000 rpm or more.

As shown in FIG. 4, in the gear pump of the first conventional example, the discharge flow rate from the discharge port increased with an increase in rotational speed of the inner rotor 3, but cavitation was recognized when the rotational speed of the inner rotor 3 reached a value N1. In the gear pump of the second conventional example, when the rotational speed of the inner rotor 3 became equal to or higher than a predetermined rotational speed, the discharge flow rate from the discharge port reached its peak and did not increase even if the rotational speed of the inner rotor 3 further increased. This shows that the gear pump of the second conventional example has lower hydraulic oil suction efficiency in the higher rotational speed range than the gear pump of the first conventional example. In the gear pump of the second conventional example, no cavitation was recognized until the rotational speed of the inner rotor 3 reached a value N2 higher than the value N1.

On the other hand, in the gear pump of the exemplary embodiment, the discharge flow rate from the discharge port increased with an increase in rotational speed of the inner rotor 3. Although the gear pump of the exemplary embodiment had lower suction efficiency in the higher rotational speed range than the gear pump of the first conventional example, the discharge flow rate from the discharge port did not reach its peak in the higher rotational speed range like the gear pump of the second conventional example. In the gear pump of the present exemplary embodiment sufficient hydraulic oil suction efficiency can thus be ensured even in the higher rotational speed range. In the gear pump of the exemplary embodiment, like the gear pump of the second conventional example, no cavitation was recognized until the rotational speed of the inner rotor 3 reached the value N2 higher than the value N1. It is understood from the result in FIG. 4 that the gear pump of the present exemplary embodiment can maintain satisfactory hydraulic oil suction efficiency from a region where the rotational speed of the inner rotor 3 is low to a region where the rotational speed of the inner rotor 3 is high, and can satisfactorily suppress cavitation, and that, according to the present embodiment, oil pumps ranging from a low rotation type to a high rotation type can be developed by using a similar configuration.

As described above, in the gear pump 1 of the present embodiment, the outer inner wall surface 200 of the suction port 20 which is located on the downstream side in the rotor rotation direction, that is, the first inner wall surface 201, is located inward of the bottom land 42 between the internal teeth 41 of the outer rotor 4, namely the bottom land 42 between the two internal teeth 41 that define the inter-tooth chamber 50 whose communication with the suction port 20 is about to cut off. The outer inner wall surface 200, that is, the first inner wall surface 201, thus restricts flow of the hydraulic oil in the outward direction. Accordingly, the hydraulic oil can be collected on the inner side of the suction port 20, and can be made to flow into the inter-tooth chamber 50 from the inner side (the inner peripheral side) of the suction port 20. This can improve filling efficiency in the inner part (part on the inner peripheral side) of the inter-tooth chamber 50, and can suppress cavitation. The suction port 20 of the gear pump 1 has the shallow portion 21 that is extended inward from the first inner wall surface 201 of the outer inner wall surface 200 on the downstream side in the rotor rotation direction. This can increase the flow rate of the hydraulic oil that flows (is sucked) into the inter-tooth chamber 50 whose communication with the suction port 20 is about to cut off, and can facilitate filling of the inter-tooth chamber 5 with the hydraulic oil. As a result, the gear pump 1 can improve suction efficiency while satisfactorily suppressing cavitation associated with suction of the hydraulic oil into the inter-tooth chambers 50, and generation of noise resulting from the cavitation.

In the gear pump 1, communication between the inter-tooth chamber 50 and the suction port 20 is cut off with the inter-tooth chamber 50 facing only the shallow portion 21. This can further facilitate entry (suction) of the hydraulic oil into the inter-tooth chamber 50 whose communication with the suction port 20 is about to cut off, and can more satisfactorily suppress cavitation.

Moreover, in the gear pump 1, the portion located upstream of the closing portion 206 in the rotor rotation direction in the outer inner wall surface 200, namely the closing portion 206 of the suction port 20 where communication with the inter-tooth chamber 50 is cut off, that is, the first inner wall surface 201, is located inward of the bottom land 42 between the two internal teeth 41 that define the inter-tooth chamber 50 whose communication with the suction port 20 is about to cut off. The end located on the downstream side of the suction port 20 in the rotor rotation direction is thus formed so as to face approximately the entire external teeth 31 of the inner rotor, whereby it is ensured that the suction port 20 has a sufficient width in the rotor radial direction at this end.

The outer inner wall surface 200 of the suction port 20 includes the first inner wall surface 201 that extends inward from the outer periphery of the outer rotor, and the second inner wall surface 205 that is continuous with the first inner wall surface 201 and the inner inner wall surface of the suction port 20 and that extends further inward than the first inner wall surface 201 does. The closing portion 206 is determined on the continuous surface 202 as a continuous portion between the first inner wall surface 201 and the second inner wall surface 205. Outward expansion of the first inner wall surface 201 in the rotor radial direction is thus suppressed, and it is ensured that the suction port 20 has a sufficient width in the rotor radial direction at its end located on the downstream side in the rotor rotation direction. This can further improve suction efficiency while more satisfactorily suppressing cavitation associated with suction of the hydraulic oil.

The deep portion 23 of the suction port 20 formed so as to be continuous with the shallow portion 21 includes the tilted portion 22 that is formed so as to be continuous with the shallow portion 21 and to have a greater depth toward the upstream side in the rotor rotation direction. The flow of the hydraulic oil in the suction port 20 can thus be adjusted by the tilted portion 22, and the hydraulic oil can be smoothly guided into the expanded inter-tooth chambers 50. The tilt angle of the surface of the shallow portion 21 need only be smaller than that of the surface of the tilted portion 22. As described above, instead of forming the surface of the shallow portion 21 as a flat surface, the surface of the shallow portion 21 may be slightly tilted so as to be located closer to the inter-tooth chamber 50 as it extends closer to the outer inner wall surface 200, namely the first inner wall surface 201, the continuous surface 202, the second inner wall surface 205, etc., from a boundary 22*b* with the tilted portion 22.

Moreover, in the gear pump 1, communication between the inter-tooth chamber 50 and the suction port 20 is cut off as the contact portion (closest portion) between the external tooth 31 and the internal tooth 41 which are located on the upstream side of the inter-tooth chamber 50 in the rotor rotation direction overlaps the closing portion 206 determined on the outer inner wall surface 200 of the suction port 20. The hydraulic oil can thus be made to flow into (fill) the inter-tooth chamber 50 after air is removed from the hydraulic oil flowing near the outer inner wall surface 200 (especially the first inner wall surface 201) by the effect of centrifugal force. Cavitation can thus be satisfactorily suppressed especially when the inner rotor 3 rotates at a high speed.

Figure 5:
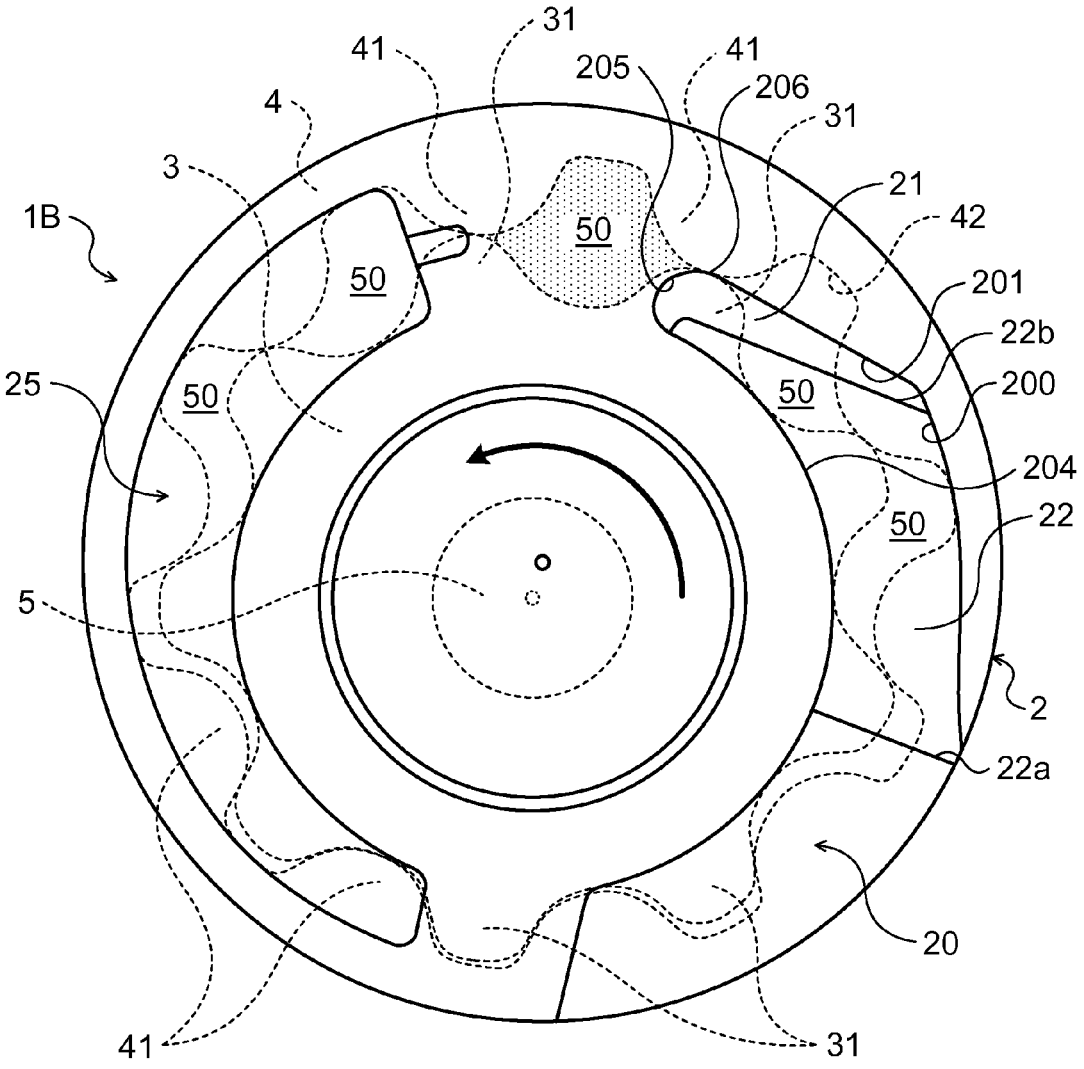
FIG. 5 is a schematic configuration diagram showing a gear pump 1B according to a modification.
Figure 6:
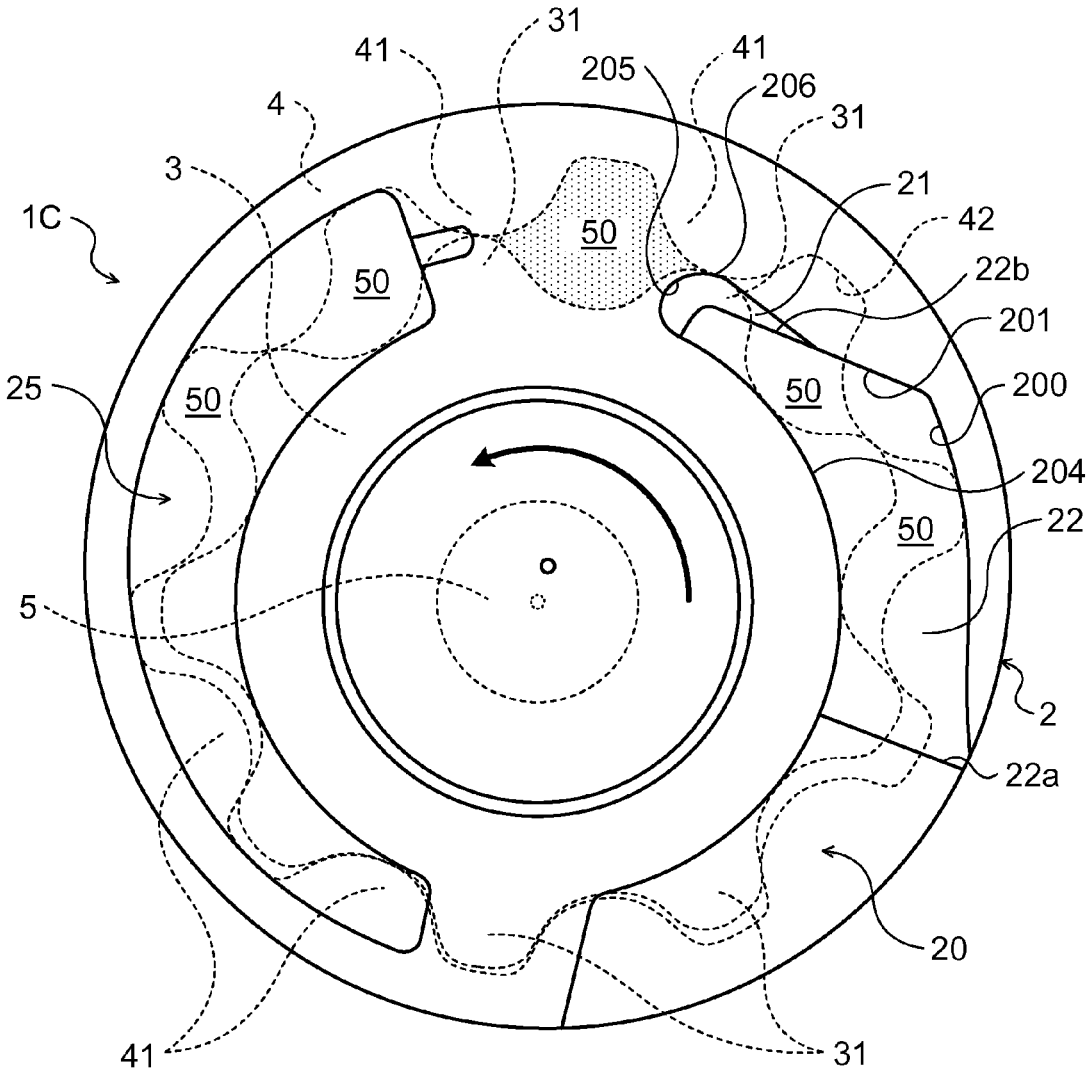
FIG. 6 is a schematic configuration diagram showing a gear pump 1C according to another modification.
Figure 7:
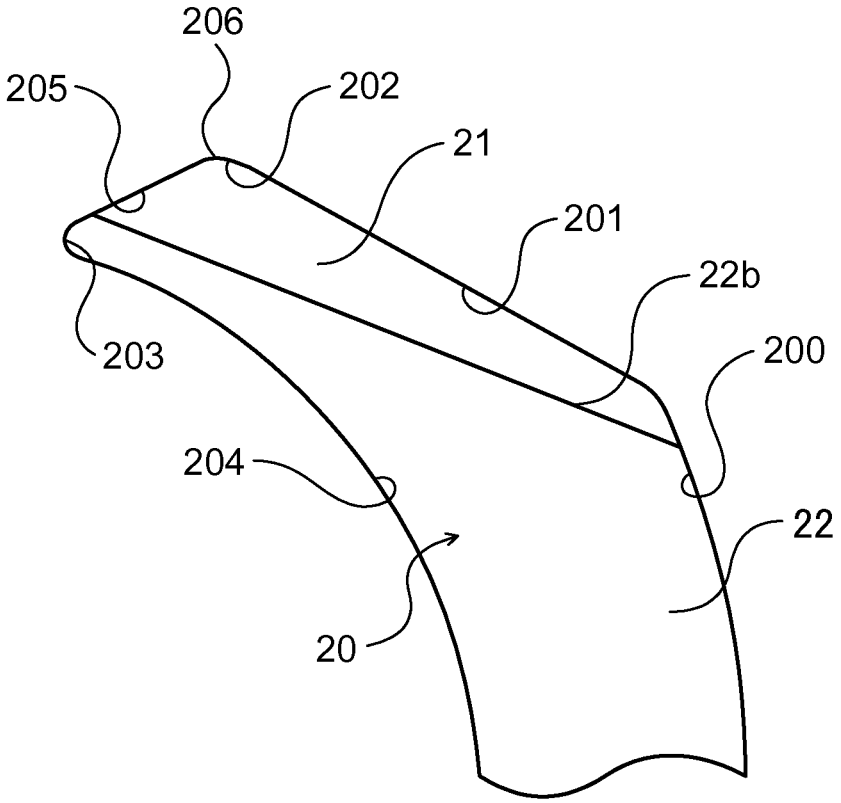
FIG. 7 is an enlarged view showing a modification of the suction port 20.

In the above embodiment, the second inner wall surface 205 included in the outer inner wall surface 200 of the suction port 20 is formed as a flat surface. However, the second inner wall surface 205 may be formed as a curved surface, as in gear pumps 1B, 1C shown in FIGS. 5 and 6. In this case, the continuous surfaces 202, 203 in the above embodiment can be omitted. The second inner wall surface 205 may be formed by combination of a plurality of flat surfaces. As shown in FIG. 6, the first inner wall surface 201 included in the outer inner wall surface 200 of the suction port 20 may be formed as a recessed surface that is recessed inward in the rotor radial direction. In this case, the first inner wall surface 201 may be formed by combination of a plurality of flat surfaces as shown in FIG. 6, or may be formed by a curved surface. Moreover, like the gear pump 1C shown in FIG. 6, the shallow portion 21 may be formed so as to extend along only a part of the first inner wall surface 201 which is located on the second inner wall surface 205 side. As shown in FIG. 7, the shallow portion 21 may be formed so that the boundary 22*b* with the tilted portion 22 extends linearly and extends along the first inner wall surface 201, the continuous surface 202, and a part of the second inner wall surface 205 which is located on the continuous surface 202 side in the suction port 20.

Figure 8:
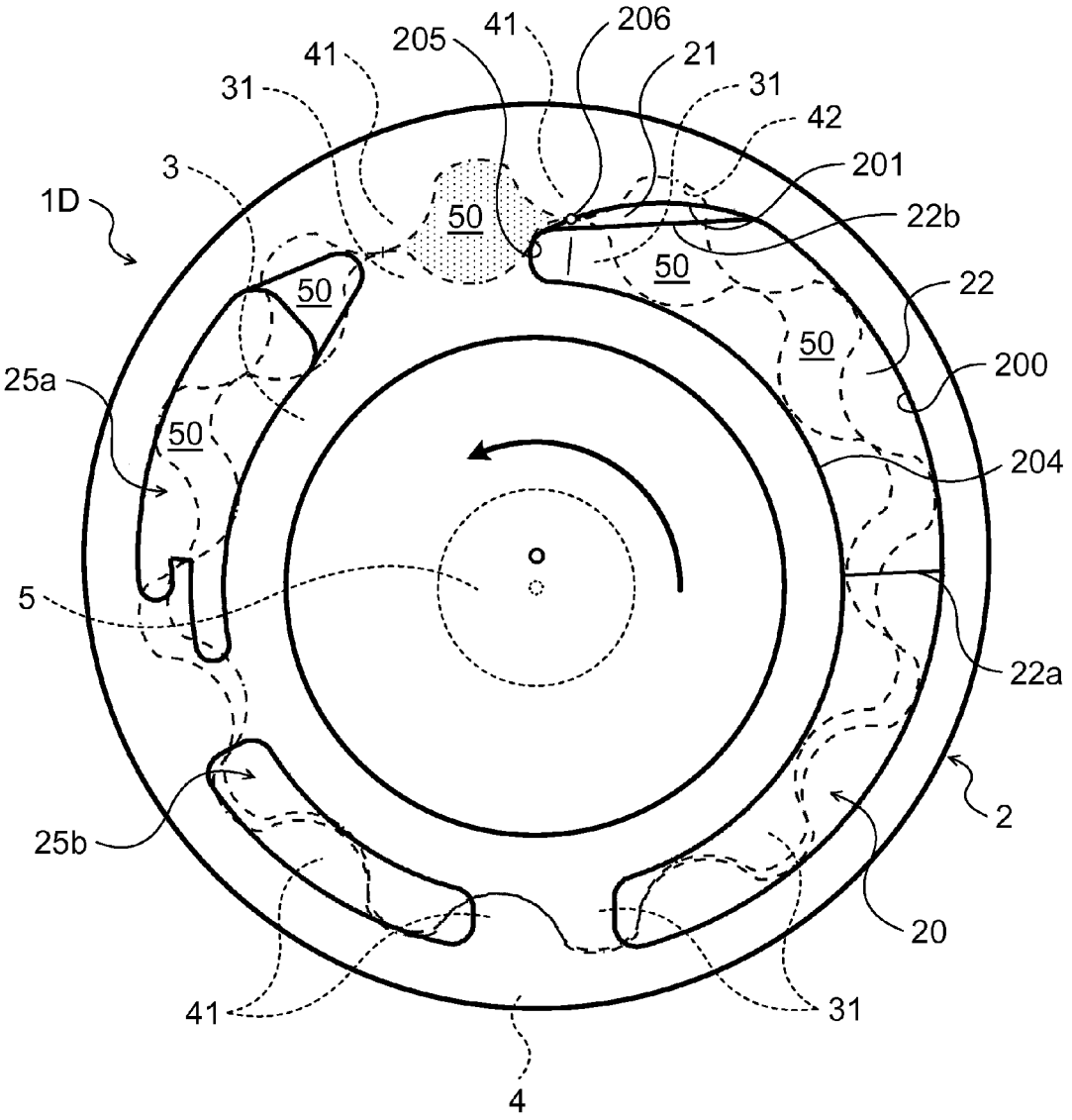
FIG. 8 is a schematic configuration diagram showing a gear pump 1D according to still another modification.
Figure 9:
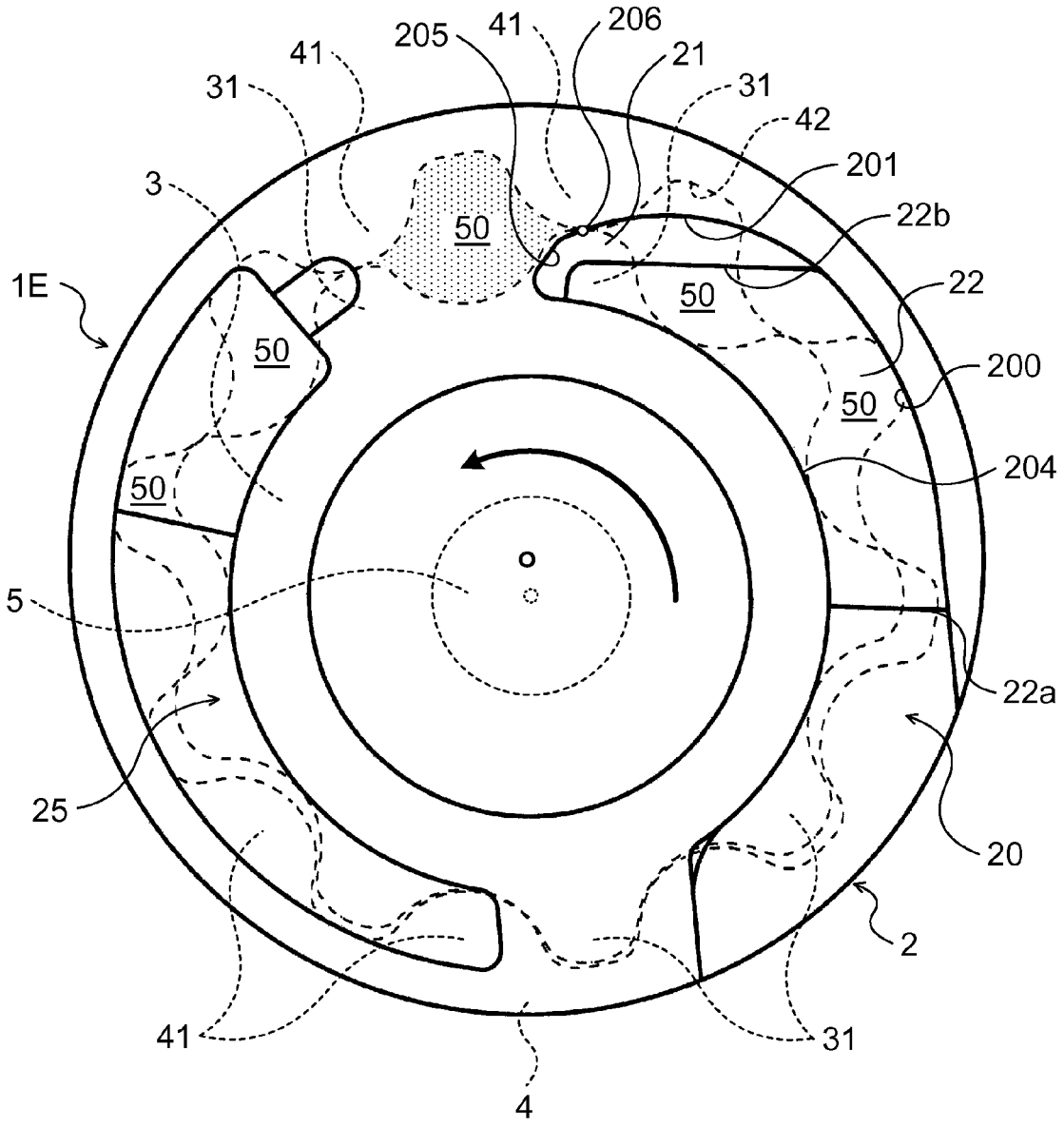
FIG. 9 is a schematic configuration diagram showing a gear pump 1E according to a further modification.

Moreover, as shown in FIGS. 8 and 9, the first inner wall surface 201 forming a part of the outer inner wall surface 200, which extends along the shallow portion 21 may be formed as a protruding surface that protrudes outward, namely toward the outer periphery of the outer rotor 4 (outward in the rotor radial direction), as long as the first inner wall surface 201 is located inward (toward the rotation axis of the inner rotor 3 and the outer rotor 4) of the bottom land between the internal teeth 41 of the outer rotor 4, namely the bottom land 42 between the two internal teeth 41 that define the inter-tooth chamber 50 whose communication with the suction port 20 is about to cut off. In a gear pump 1D shown in FIG. 8 and a gear pump 1E shown in FIG. 9, the first inner wall surface 201 extending along the shallow portion 21 is a curved surface extending in, e.g., an arc shape curved outward, that is, toward the outer periphery of the outer rotor 4. The closing portion 206 that overlaps the contact portion (closest portion) between the external tooth 31 and the internal tooth 41 when communication between the inter-tooth chamber 50 and the suction port 20 is cut off is determined on the first inner wall surface 201 as a curved surface.

In the gear pumps 1D, 1E, the direction in which the hydraulic oil from the suction port 20 flows can thus be smoothly changed by the first inner wall surface 201 of the outer inner wall surface 200 extending along the shallow portion 21. This can maintain a high flow rate of the hydraulic oil flowing (sucked) into the inter-tooth chamber 50 whose communication with the suction port 20 is about to cut off, and thus can very satisfactorily facilitate filling of the inter-tooth chamber 50 whose communication with the suction port 20 is about to cut off with the hydraulic oil in the gear pump 1D shown in FIG. 8 and the gear pump 1E shown in FIG. 9. Moreover, in the gear pumps 1D, 1E as well, the hydraulic oil can be made to flow into (fill) the inter-tooth chamber 50 after air is removed from the hydraulic oil flowing near the outer inner wall surface 200 (especially the first inner wall surface 201) by the effect of centrifugal force. This can satisfactorily suppress cavitation especially when the inner rotor 3 rotates at a high speed. In the gear pumps 1D, 1E, the first inner wall surface 201 extending along the shallow portion 21 may be formed by combination of a plurality of flat surfaces. The gear pump 1D shown in FIG. 8 includes two independent discharge ports 25*a*, 25*b* that communicate with (face) those inter-tooth chambers 5 which contract with rotation of the inner rotor 3 and the outer rotor 4 out of the plurality of inter-tooth chambers 5. This can further improve discharge capability of the gear pump 1D while making its overall device compact.

In the gear pumps 1 to 1E, each external tooth 31 of the inner rotor 3 and each internal tooth 41 of the outer rotor 4 may be formed asymmetrically with respect to a line segment connecting the top land of the addendum and the rotation axis of the inner rotor 3 or the outer rotor 4. When communication between the uppermost inter-tooth chamber 50 in FIG. 1 etc. and the suction port 20 is cut off, communication between this inter-tooth chamber 50 and the discharge port 25 is also cut off. The gear pump 1 may be configured so that the uppermost inter-tooth chamber 50 in FIG. 1 etc. communicates with the discharge port 25 when communication between this inter-tooth chamber 50 and the suction port 20 is cut off. Moreover, in the gear pump 1 shown in FIG. 1, etc., the inter-tooth chamber 50 where communication with the suction port 20 is cut off has the largest capacity, but the present embodiment is not limited to this. The gear pump according to the present embodiment may be configured so that communication between the inter-tooth chamber and the suction port is cut off as a portion other than the closest portion of the external tooth and the internal tooth which are located on the upstream side of the inter-tooth chamber in the rotor rotation direction overlaps the closing portion on the outer inner wall surface etc.

Although the mode for carrying out the preferred embodiment is described above, it should be understood that it is not limited in any way, and various modifications can be made.

INDUSTRIAL APPLICABILITY

The present embodiment can be used in the industry of manufacturing of gear pumps.

The invention claimed is:

1. A gear pump including an inner rotor that has a plurality of external teeth and that is driven to rotate, an outer rotor that has a plurality of internal teeth, that is placed so as to be offset with respect to the inner rotor, and that rotates together with the inner rotor with a part of the plurality of internal teeth meshing with a part of the plurality of external teeth, a suction port that communicates with such an inter-tooth chamber that increases in capacity with rotation of the inner rotor and the outer rotor out of a plurality of inter-tooth chambers defined by the external teeth and the internal teeth, and a discharge port that communicates with such an inter-tooth chamber that reduces in capacity with rotation of the inner rotor and the outer rotor out of the plurality of inter-tooth chambers, wherein an outer inner wall surface of the suction port which is located on a downstream side in a rotor rotation direction is located inward of a bottom land between the internal teeth, and the suction port has a shallow portion extended inward from the outer inner wall surface on the downstream side in the rotor rotation direction, and a deep portion that is formed so as to be continuous with the shallow portion and that is deeper than the shallow portion, and the outer inner wall surface that is located upstream, in the rotor rotation direction, of a closing portion of the suction port where communication with the inter-tooth chamber is cut off is located inward of the bottom land between the internal teeth that define the inter-tooth chamber whose communication with the suction port is about to cut off.

2. The gear pump according to claim 1, wherein communication between the inter-tooth chamber and the suction port is cut off with the inter-tooth chamber facing only the shallow portion.

3. The gear pump according to claim 1, wherein the outer inner wall surface extending along the shallow portion is a curved surface that is curved outward.

4. The gear pump according to claim 1, wherein the outer inner wall surface of the suction port includes a first inner wall surface that extends inward from an outer periphery of the outer rotor, and a second inner wall surface that is continuous with the first inner wall surface and an inner inner wall surface of the suction port and that extends further inward than the first inner wall surface does, and the closing portion of the suction port where communication with the inter-tooth chamber is cut off is determined on a continuous portion between the first inner wall surface and the second inner wall surface.

5. The gear pump according to claim 1, wherein the deep portion includes a tilted portion that is continuous with the shallow portion and that is formed so as to have a greater depth toward an upstream side in the rotor rotation direction.

6. The gear pump according to claim 1, wherein communication between the inter-tooth chamber and the suction port is cut off as a closest portion between the external tooth and the internal tooth which are located on an upstream side of the inter-tooth chamber in the rotor rotation direction overlaps the closing portion of the outer inner wall surface.

7. A gear pump including an inner rotor that has a plurality of external teeth and that is driven to rotate, an outer rotor that has a plurality of internal teeth, that is placed so as to be offset with respect to the inner rotor, and that rotates together with the inner rotor with a part of the plurality of internal teeth meshing with a part of the plurality of external teeth, a suction port that communicates with such an inter-tooth chamber that increases in capacity with rotation of the inner rotor and the outer rotor out of a plurality of inter-tooth chambers defined by the external teeth and the internal teeth, and a discharge port that communicates with such an inter-tooth chamber that reduces in capacity with rotation of the inner rotor and the outer rotor out of the plurality of inter-tooth chambers, wherein an outer inner wall surface of the suction port which is located on a downstream side in a rotor rotation direction is located inward of a bottom land between the internal teeth, the suction port has a shallow portion extended inward from the outer inner wall surface on the downstream side in the rotor rotation direction, and a deep portion that is formed so as to be continuous with the shallow portion and that is deeper than the shallow portion, and communication between the inter-tooth chamber and the suction port is cut off as a closest portion between the external tooth and the internal tooth which are located on an upstream side of the inter-tooth chamber in the rotor rotation direction overlaps the closing portion of the outer inner wall surface.

8. The gear pump according to claim 7, wherein the outer inner wall surface that is located upstream, in the rotor rotation direction, of a closing portion of the suction port where communication with the inter-tooth chamber is cut off is located inward of the bottom land between the internal teeth that define the inter-tooth chamber whose communication with the suction port is about to cut off.

9. The gear pump according to claim 7, wherein the outer inner wall surface extending along the shallow portion is a curved surface that is curved outward.

10. The gear pump according to claim 7, wherein the outer inner wall surface of the suction port includes a first inner wall surface that extends inward from an outer periphery of the outer rotor, and a second inner wall surface that is continuous with the first inner wall surface and an inner inner wall surface of the suction port and that extends further inward than the first inner wall surface does, and the closing portion of the suction port where communication with the inter-tooth chamber is cut off is determined on a continuous portion between the first inner wall surface and the second inner wall surface.

11. The gear pump according to claim 7, wherein the deep portion includes a tilted portion that is continuous with the shallow portion and that is formed so as to have a greater depth toward an upstream side in the rotor rotation direction.

12. The gear pump according to claim 11, wherein a tilt angle of the shallow portion is smaller than that of the tilted portion.

13. The gear pump according to claim 7, wherein communication between the inter-tooth chamber and the suction port is cut off with the inter-tooth chamber facing only the shallow portion.

14. A gear pump including an inner rotor that has a plurality of external teeth and that is driven to rotate, an outer rotor that has a plurality of internal teeth, that is placed so as to be offset with respect to the inner rotor, and that rotates together with the inner rotor with a part of the plurality of internal teeth meshing with a part of the plurality of external teeth, a suction port that communicates with such an inter-tooth chamber that increases in capacity with rotation of the inner rotor and the outer rotor out of a plurality of inter-tooth chambers defined by the external teeth and the internal teeth, and a discharge port that communicates with such an inter-tooth chamber that reduces in capacity with rotation of the inner rotor and the outer rotor out of the plurality of inter-tooth chambers, wherein an outer inner wall surface of the suction port which is located on a downstream side in a rotor rotation direction is located inward of a bottom land between the internal teeth, the suction port has a shallow portion extended inward from the outer inner wall surface on the downstream side in the rotor rotation direction, and a deep portion that is formed so as to be continuous with the shallow portion and that is deeper than the shallow portion, and the deep portion includes a tilted portion that is continuous with the shallow portion and that is formed so as to have a greater depth toward an upstream side in the rotor rotation direction.

15. The gear pump according to claim 14, wherein communication between the inter-tooth chamber and the suction port is cut off with the inter-tooth chamber facing only the shallow portion.

16. The gear pump according to claim 14, wherein the outer inner wall surface that is located upstream, in the rotor rotation direction, of a closing portion of the suction port where communication with the inter-tooth chamber is cut off is located inward of the bottom land between the internal teeth that define the inter-tooth chamber whose communication with the suction port is about to cut off.

17. The gear pump according to claim 14, wherein the outer inner wall surface extending along the shallow portion is a curved surface that is curved outward.

18. The gear pump according to claim 14, wherein the outer inner wall surface of the suction port includes a first inner wall surface that extends inward from an outer periphery of the outer rotor, and a second inner wall surface that is continuous with the first inner wall surface and an inner inner wall surface of the suction port and that extends further inward than the first inner wall surface does, and the closing portion of the suction port where communication with the inter-tooth chamber is cut off is determined on a continuous portion between the first inner wall surface and the second inner wall surface.

19. The gear pump according to claim 14, wherein a tilt angle of the shallow portion is smaller than that of the tilted portion.

20. The gear pump according to 14, wherein communication between the inter-tooth chamber and the suction port is cut off as a closest portion between the external tooth and the internal tooth which are located on an upstream side of the inter-tooth chamber in the rotor rotation direction overlaps the closing portion of the outer inner wall surface.

* * * * *